US008365480B1

(12) United States Patent
Plummer et al.

(10) Patent No.: US 8,365,480 B1
(45) Date of Patent: Feb. 5, 2013

(54) DOOR ASSEMBLY WITH DUAL SUPPORT CONNECTOR ASSEMBLY

(75) Inventors: John B. Plummer, Houston, TX (US); Joseph Gene Denley, Cypress, TX (US)

(73) Assignee: Glasscraft Door Company, Houston, TX (US)

( * ) Notice: Subject to any disclaimer, the term of this patent is extended or adjusted under 35 U.S.C. 154(b) by 0 days.

(21) Appl. No.: 13/533,776

(22) Filed: Jun. 26, 2012

(51) Int. Cl.
*E06B 3/00* (2006.01)

(52) U.S. Cl. ..... 52/208; 52/204.62; 52/204.72; 52/455

(58) Field of Classification Search ..... 52/205, 52/208, 455, 456, 204.62, 204.72, 204.61, 52/656.4, 745.16
See application file for complete search history.

(56) References Cited

U.S. PATENT DOCUMENTS

| | | | | |
|---|---|---|---|---|
| 3,750,358 | A | 8/1973 | Lewkowitz | |
| 3,760,543 | A | 9/1973 | McAllister | |
| 3,903,669 | A | 9/1975 | Pease, Jr. et al. | |
| 4,021,967 | A | 5/1977 | Mulder et al. | |
| 4,241,556 | A * | 12/1980 | Bursk | 52/455 |
| 4,246,731 | A | 1/1981 | Miro | |
| 4,720,951 | A | 1/1988 | Thorn et al. | |
| 4,735,025 | A | 4/1988 | Day | |
| 4,920,718 | A | 5/1990 | Artwick et al. | |
| 5,018,330 | A * | 5/1991 | Lewkowitz | 52/455 |
| 5,133,168 | A | 7/1992 | Neilly et al. | |
| 5,249,403 | A | 10/1993 | Neilly et al. | |
| 5,570,548 | A | 11/1996 | Hopper | |
| 5,634,508 | A | 6/1997 | Herbst | |
| 5,644,881 | A * | 7/1997 | Neilly | 52/455 |
| 5,894,706 | A | 4/1999 | Herbst | |
| 6,151,849 | A * | 11/2000 | Twigg et al. | 52/208 |
| 6,272,801 | B1 | 8/2001 | Suh | |
| 6,546,682 | B1 * | 4/2003 | DeBlock et al. | 52/204.72 |
| 6,574,935 | B2 | 6/2003 | Wang et al. | |
| 6,694,701 | B2 | 2/2004 | Wang et al. | |
| 6,925,767 | B2 | 8/2005 | Krochmal et al. | |
| 7,448,174 | B2 | 11/2008 | Krochmal et al. | |
| D613,878 | S | 4/2010 | Walsh et al. | |
| D625,838 | S | 10/2010 | Walsh et al. | |
| 8,146,304 | B1 * | 4/2012 | Plummer et al. | 52/204.61 |
| 2003/0041539 | A1 | 3/2003 | Bernacki et al. | |
| 2003/0056442 | A1 | 3/2003 | Gerard | |
| 2004/0085711 | A1 * | 5/2004 | Merker et al. | 361/523 |
| 2007/0193140 | A1 * | 8/2007 | Carnick et al. | 52/208 |
| 2009/0090062 | A1 * | 4/2009 | Pandorf | 49/50 |
| 2010/0064625 | A1 | 3/2010 | Charlton et al. | |
| 2010/0229500 | A1 * | 9/2010 | Lynch et al. | 52/784.13 |

OTHER PUBLICATIONS

Definition of the term "plastic" found at: http://dictionary.reference.com/browse/plastic.*

* cited by examiner

*Primary Examiner* — Brian Glessner
*Assistant Examiner* — Brian D Mattei
(74) *Attorney, Agent, or Firm* — Buskop Law Group, PC; Wendy Buskop

(57) ABSTRACT

A door assembly with installed glass panel, or insulated glass panel, security glass panel, or a decorative leaded glass panel, void of holes in the door or in glass panel, wherein the door assembly has a dual support connector with connector body, connector hole extending through the connector body, a glass flange integral with the connector body for overlaying an edge portion of the glass panel; an structural panel flange integral with the connector body, extending at a right angle to the connector hole away from the connector body parallel to while opposite the glass panel flange for overlaying an edge portion of the structural panel while in a plane apart from a plane of the glass flange.

17 Claims, 10 Drawing Sheets

FIGURE 10A
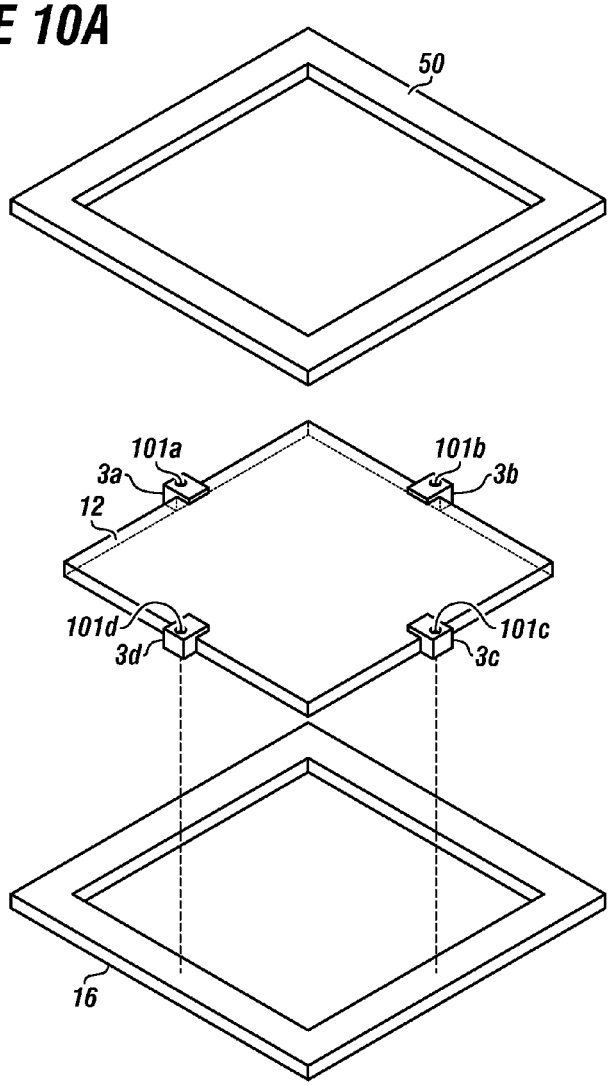
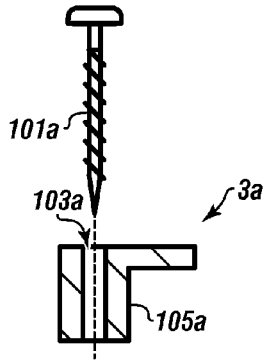
FIGURE 10B

DOOR ASSEMBLY WITH DUAL SUPPORT CONNECTOR ASSEMBLY

FIELD

The present embodiments generally relate to a door or window assembly created at a facility wherein the door assembly or window assembly has a glass panel held to the door or window support panels using a dual support connector.

BACKGROUND

A need exists for a door assembly wherein the connectors, holding a glass panel and forming a door light, are concealed and further do not create holes in the door or window.

A need exists for a door assembly that is quick to install, easy to use, and does not require specialized training for workers.

A need exists for a door assembly that allows replacement glass to be installed into existing doors and windows easily by a customer for improved insulation to conserve the use of fossil fuels and associated energy costs.

A need exists for a homeowner to easily implement on a door assembly a security grill with security glass in locations with increased crime rates to provide increased levels of safety and security in homes containing children and senior citizens.

A further need exists for a door assembly with lightweight connectors that are rust resistant, able to be hidden within the door, and do not form holes in parts of the existing door or window.

The present embodiments meet these needs.

BRIEF DESCRIPTION OF THE DRAWINGS

The detailed description will be better understood in conjunction with the accompanying drawings as follows:

FIG. 10A depicts a kit created to retrofit a glass panel into a door to form the door assembly.

FIG. 10B depicts an isometric view of a shipping clip and a shipping fastener usable with the kit of FIG. 10A.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that they can be practiced or carried out in various ways.

The current embodiments relate to a door assembly or window assembly with a glass panel held to the door or window with a plurality of unique dual support connectors and two frames.

The dual support connectors allow the glass to be positioned in a door opening safely and efficiently either in the field on an installed door or in a factory that builds new doors even if the glass does not provide a "perfect" flush fit within the door opening or the door frame support panels are not at perfect right angles to each other.

In embodiments, the door assemblies can be composed of fiberglass, steel, or composite materials.

The door assembly can allow the glass of the door assembly to be easily replaced without special tools.

The door assembly can allow lower costs for a door manufacturer by not requiring the additional labor necessary to form edge flanges in the opening of the door.

The door assembly can allow frames of the door light to be self-aligning in the opening.

The door assembly can allow the glass in a door mounted without any visible mounting holes formed in the door face or insert frame.

The embodiments further relate to window frame assemblies that can be installed without visible screw holes through the use of uniquely shaped dual support connectors to hold the frames into the window.

The door and window assemblies can help the American economy because the consumer will be able to fix frames in doors and windows with broken frames or replace glass that is not energy efficient when the support panels of the door or window are out of alignment without buying a new door and without a significant time investment.

The door assembly can provide a window assembly that can be easily disassembled for broken glass replacement, having an integral alignment system that allows the frames holding the replacement glass to be easily and properly aligned over the connectors and in the opening of the door assembly.

The door assembly can be any door, such as a Craftsman style door or not a Craftsman style door.

Figure 1:
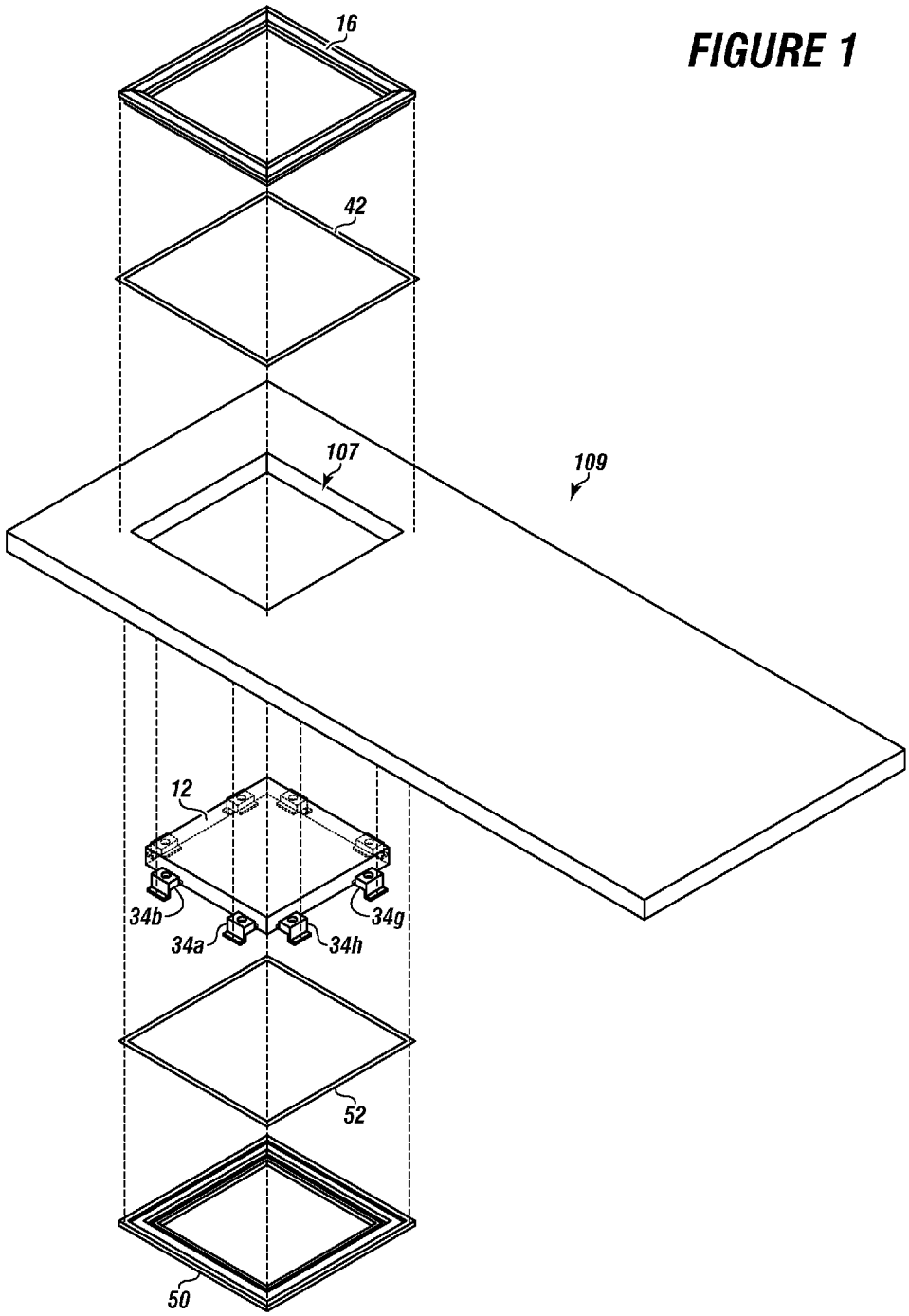
FIG. 1 depicts an assembly schematic of a door assembly using a dual support connector assembly.

Turning now to the Figures, FIG. 1 depicts an assembly schematic of a door assembly formed using a dual support connector assembly.

A door 109 can have an opening 107. An exterior frame 16 can be disposed about the opening 107.

A first seal 42 can be disposed on the exterior frame 16. The seals can be a gasket, a curable silicone sealant, a cross linked elastomer, a resin, an adhesion promoter, a natural rubber, a synthetic rubber, or combinations thereof.

A glass panel 12 can be disposed between the first seal 42 and tape 52. The glass panel 12 can be an insulated glass assembly; a single glass pane; a leaded glass insert; a stained glass insert; a security panel, such as tempered or laminated glass; or combinations of these panels.

Dual support connectors 34*a*-34*h* can be positioned over an edge of the glass panel. The dual support connectors 34*a*-34*h* can connect with the glass panel 12 and the exterior frame 16.

The interior frame 50 can be disposed about the opening 107 on a side of the door 109 opposite the exterior frame 16. For example, the interior frame 50 can be located on the side of the door 109 that faces the interior of a house when the door is shut, and the exterior frame 16 can be disposed on the side of the door 109 that faces the outside of a house when the door is shut. The interior frame 50 can be a frame or another device configured to cover all of the plurality of installed connectors and secure to the door 109 and the glass panel 12. The interior frame 50 can be similar to the exterior frame 16 in shape and appearance.

The interior frame 50 and the exterior frame 16 can be made from any structural material. Illustrative materials can include wood; metals; plastics; recycled materials, such as recycle plastic milk bottles or recycled milk carton liners; laminated materials; composite materials, such as polyvinyl chloride and sawdust composites; or combinations thereof. The interior frame 50 and the exterior frame 16 can be embossed with a decorative wood grain into the decorative face of the frame.

Figure 2:
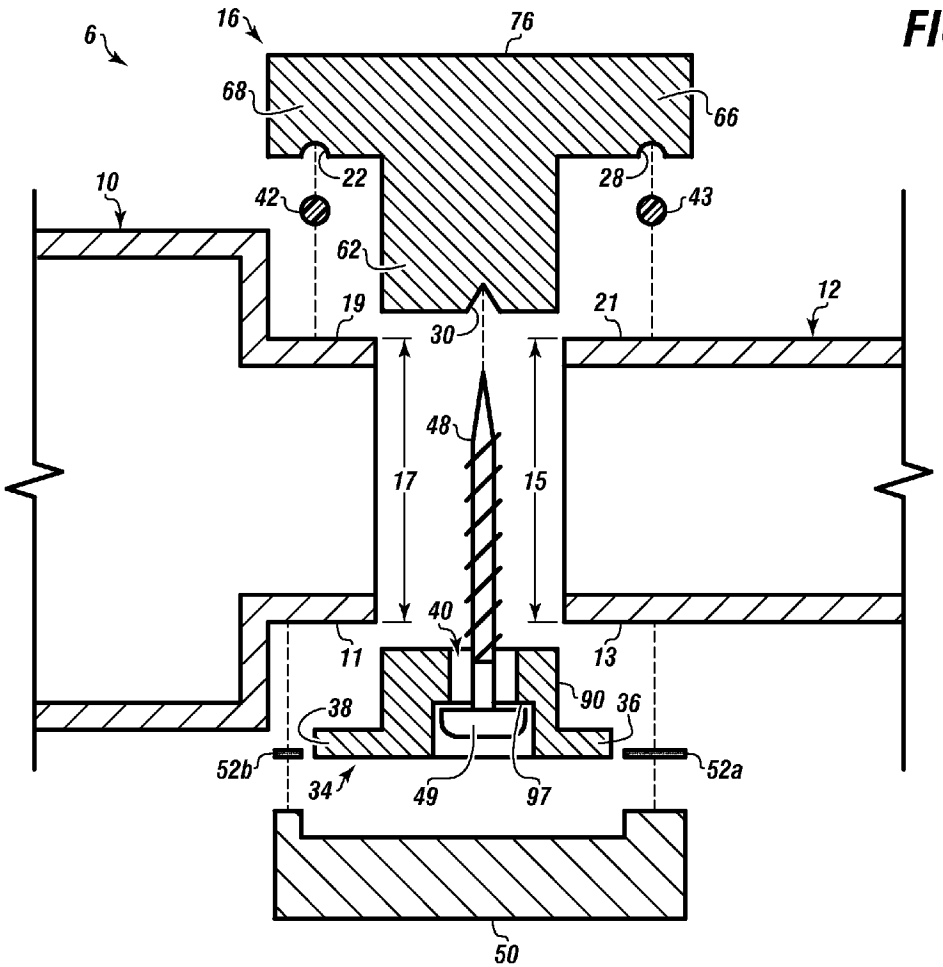
FIG. 2 depicts a detailed exploded view of the dual support connector assembly usable with the door assembly.
Figure 3:
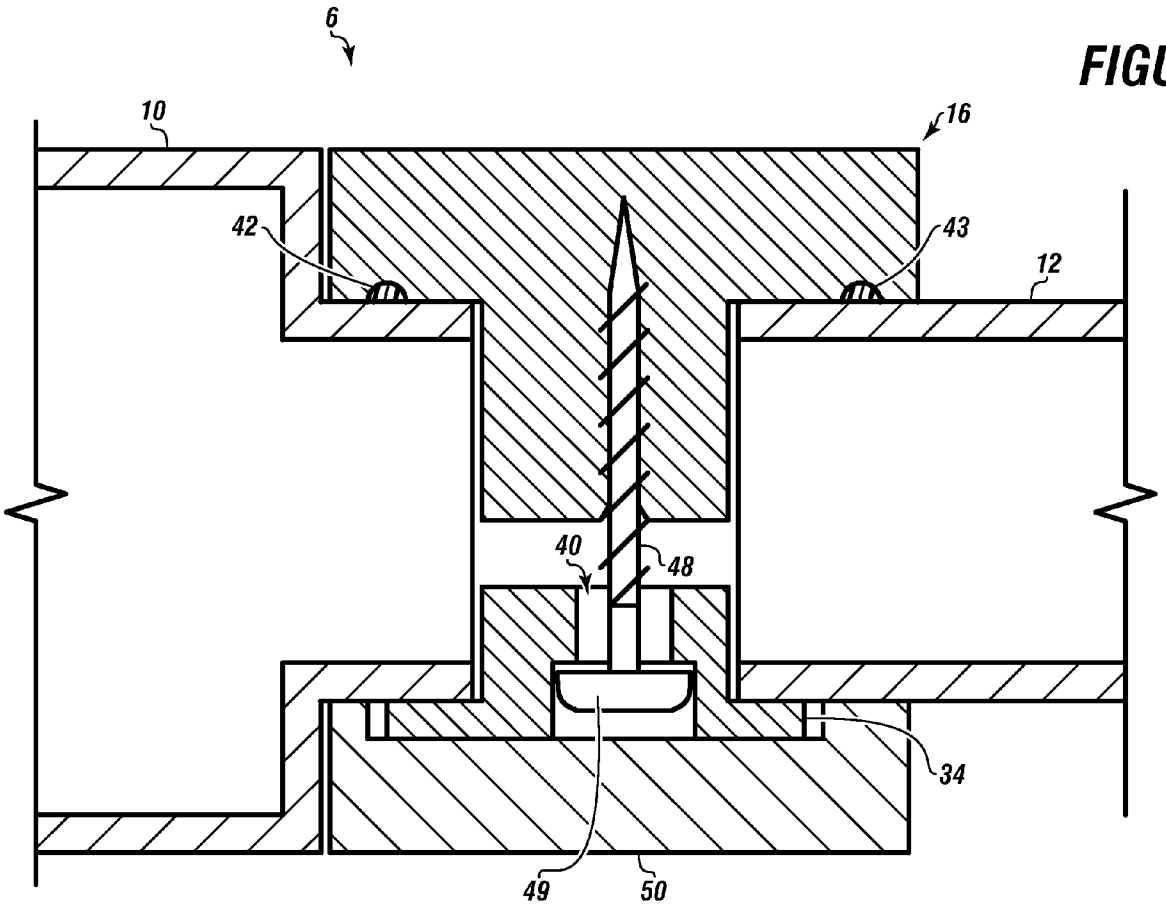
FIG. 3 depicts a detailed side view of the dual support connector assembly in an assembled configuration with the two frames, and the glass connected to the support panels of a door.

FIG. 2 depicts a detailed exploded view of the dual support connector assembly for a Craftsman style door, while FIG. 3 depicts a detailed side view of the dual support connector assembly in an assembled configuration for the same style of door.

Referring to FIGS. 2 and 3, the dual support connector assembly 6 can include the dual support connector 34. The dual support connector 34 can be used with any door. For example, the dual support connector 34 can be used with a Craftsman style door, a wood door, a Craftsman style fiberglass door, or the like. The dual support connector 34 can be disposed at least partially between the glass panel 12 and a structural panel 10.

The glass panel 12 can have a glass panel thickness 15, and the structural panel 10 has a structural panel thickness 17. The glass panel thickness 15 and the structural panel thickness 17 can be substantially similar.

The dual support connector 34 can have a connector body 90. The connector body 90 can be generally rectangular in shape.

A connector hole 40 can extend through the connector body 90. The connector hole 40 can have a connector stop 97 disposed therein for stopping a head 49 of a fastener 48 from passing through the connector body 90.

A door flange 38 can be integral with the connector body 90. The door flange 38 can extend at a right angle to the connector hole 40 away from the connector body 90 for overlaying a panel edge portion 11 of the structural panel 10. The structural panel can be a portion of the door. For example, the structural portion for a door would be the portion of the door surrounding the opening into which the glass panel 12 is affixed.

A glass flange 36 can be integral with the connector body 90 and can extend at a right angle to the connector hole 40 away from the connector body 90. The glass flange 36 can overlay a glass edge portion 13 of the glass panel 12.

The door flange 38 and the glass flange 36 can have a thickness from about 0.5 mm to about 6 mm.

The interior frame 50 can cover all the connectors simultaneously while connecting to the panel edge portion 11 and the glass edge portion 13 with fastening means 52*a* and 52*b*. The interior frame 50 can be positioned over the fastener 48 and dual support connector 34. The interior frame 50 can be slightly wider than the dual support connector 34.

First fastening means 52*a* can be used to connect the interior frame 50 to the glass edge portion 13, and a second fastening means 52*b* can be used to connect the interior frame 50 to the panel edge portion 11. The fastening means can be an adhesive, double sided tape, or the like.

The exterior frame 16 can have an exterior frame body portion 62. The exterior frame body portion 62 can have a lower portion disposed between the glass panel 12 and the structural panel 10.

An alignment groove 30 can be located on the exterior frame body portion 62. The alignment groove 30 can be on the lower portion of the exterior frame body portion 62.

The fastener 48 holds the dual support connector 34 to the glass panel 12 by engaging with the alignment groove 30. The alignment groove 30 and the dual support connector 34 can be spaced apart, allowing for size variance between the glass panel and the structural portion of the door.

The fastener 48 can be a screw, nail, or a bolt. In a headless version of the fastener, the fastener can be an epoxy, a flexible adhesive, or combinations thereof. A portion of the fastener 48 can be configured to engage the connector stop 97, preventing the fastener 48 from passing entirely through the connector hole 40.

A decorative face 76 can be located on the exterior frame body portion 62.

A first gasket groove 22 and a second gasket groove 28 can be formed in the exterior frame body portion 62. The gasket grooves can be any shape. For example, the gasket grooves can be substantially U-shaped channels running the length of the exterior frame body portion 62.

The exterior frame body portion 62 can include an exterior frame door flange 68 and an exterior frame glass flange 66.

The exterior frame door flange 68 and the exterior frame glass flange 66 can extend laterally outwardly from the exterior frame body portion 62.

The exterior frame door flange 68 can be configured to engage a structural edge 19 of the structural panel 10. The exterior frame glass flange 66 can be configured to engage a glass edge 21 of the glass panel 12. The first gasket groove 22 can be formed on the exterior frame door flange 68. The second gasket groove 28 can be located on the exterior frame glass flange 66.

A first seal 42 can be disposed within the first gasket groove 22. The first seal 42 can seal against the structural edge 19.

A second seal 43 can be disposed within the second gasket groove 28. The second seal 43 can seal against the glass edge 21.

The seals can be gaskets or another sealing device. Illustrative seals can include flexible, deformable gaskets; curable silicone sealants; a cross linked elastomer; resins; adhesion promoters; a natural or synthetic rubber; or combinations of these components. The seals can be any material capable of forming a seal.

In embodiments, the dual support connector assembly can have an antistatic coating disposed on the connector, such as rubber, to reduce shocks or static build up which can affect security systems on doors which are electronic.

Figure 4A:
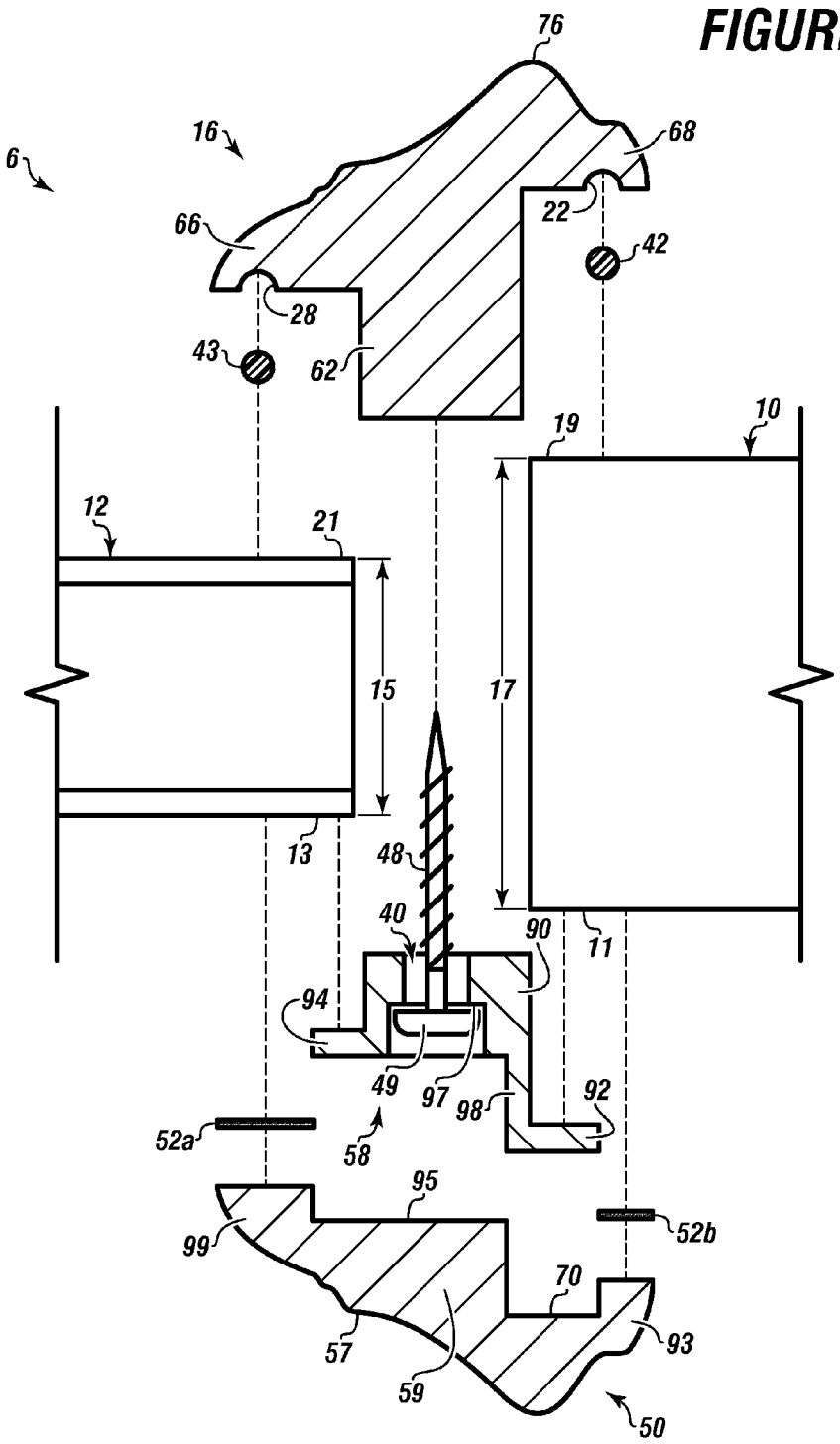
FIG. 4A depicts an exploded view of another embodiment of the dual support connector assembly usable with a door or window assembly.
Figure 4B:
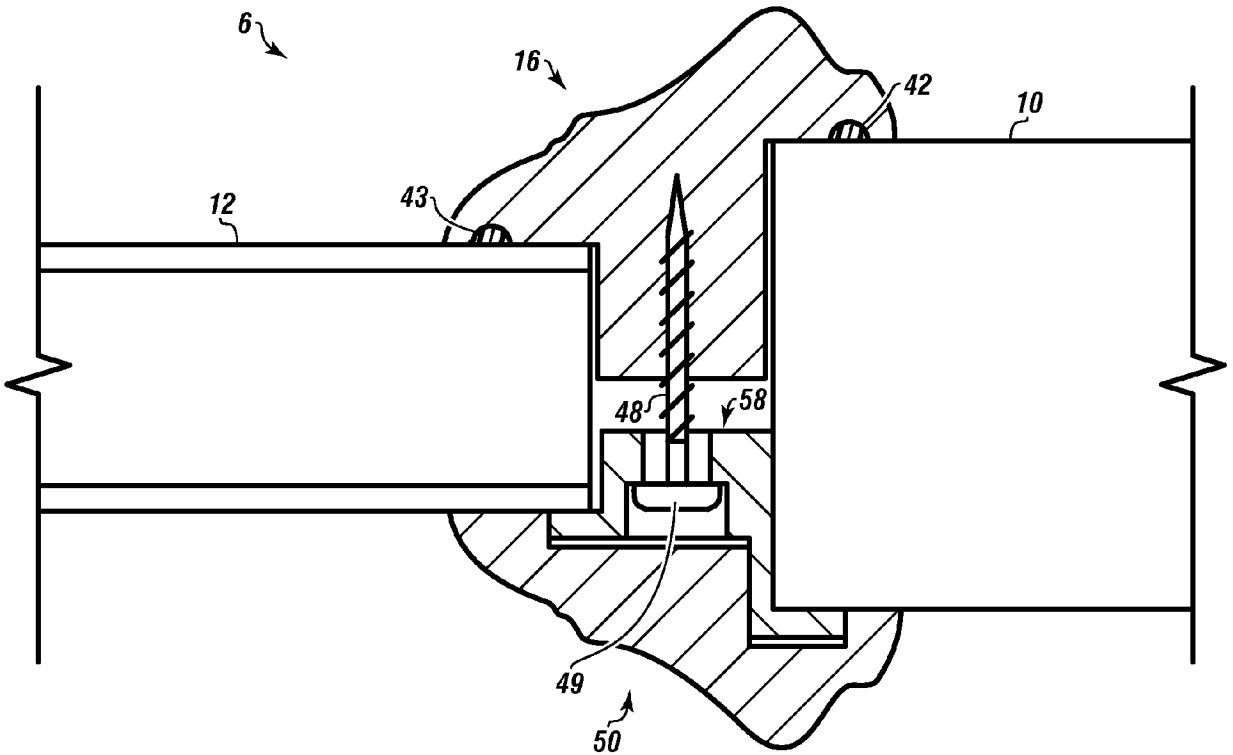
FIG. 4B is an assembled embodiment of FIG. 4A for a door or window assembly.

FIG. 4A depicts an exploded view of another embodiment of the dual support connector assembly. FIG. 4B is an assembled embodiment of FIG. 4A.

Referring to FIGS. 4A and 4B, the dual support connector assembly 6 can have a connector 58.

The connector 58 can include a connector body 90. The connector 58 can be aluminum, wood, alloys of metal, polyurethane, blends of polyester, polyvinyl chloride (PVC), acrylonitrile butadiene styrene copolymer, polyamide, styrene butadiene rubber copolymer, or combinations thereof.

The connector hole 40 can extend through the connector body 90. A connector stop 97 can be located in the connector hole 40. The connector stop 97 can engage a head 49 of the fastener 48, preventing the head of the fastener from passing through the connector hole.

The connector 58 can also include a connector glass panel flange 94 that is integral with the connector body 90. The connector glass panel flange 94 can extend at a right angle to the connector hole 40 and away from the connector body 90. The connector glass panel flange 94 can overlay the glass edge portion 13.

A connector structural panel flange 92 can be integral with the connector body 90. The connector structural panel flange 92 can extend at a right angle to the connector hole 40 away from the connector body 90. The connector structural panel flange 92 can overlay the panel edge portion 11.

The connector body 90 can include an integral flange support portion 98. The connector structural panel flange 92 can extend from the integral flange support portion 98.

The glass panel 12 can have glass panel thickness 15. The structural panel 10 can have a structural panel thickness 17. The glass panel thickness and the structural panel thickness can be unequal and can differ as much as from 5 percent to 90 percent in thickness from each other.

In embodiments, the interior frame 50 can include a connector groove 70 on an interior portion thereof for engaging the connector 58.

The exterior frame 16 can include the exterior frame body portion 62. The exterior frame body portion 62 can include a decorative face 76, an exterior frame door flange 68, and an exterior frame glass flange 66.

The exterior frame glass flange 66 can be configured to abut glass edge 21, and the exterior frame door flange 68 can be configured to abut structural edge 19.

The first gasket groove 22 is formed in the exterior frame door flange 68. The second gasket groove 28 is formed in the exterior frame glass flange 66.

A first seal 42 can be disposed between the structural panel 10 and the exterior frame door flange 68 in the first gasket groove 22.

A second seal 43 can be disposed between the exterior frame glass flange 66 and the glass panel 12 in the second gasket groove 28.

The interior frame 50 can be disposed over a plurality of connectors.

Interior frame 50 can have an interior frame body 59. The interior frame body 59 can include an interior frame glass flange 99, an interior frame door flange 93, and an interior frame decorative face 57. The interior frame body 59 can also include an interior frame intermediate face 95.

A first fastening means 52*a* can be disposed on the interior frame glass flange 99. The first fastening means 52*a* can connect the interior frame 50 to the glass edge portion 13. The second fastening means 52*b* can connect the interior frame door flange 93 to the panel edge portion 11 covering all of the plurality of connectors.

Figure 5:
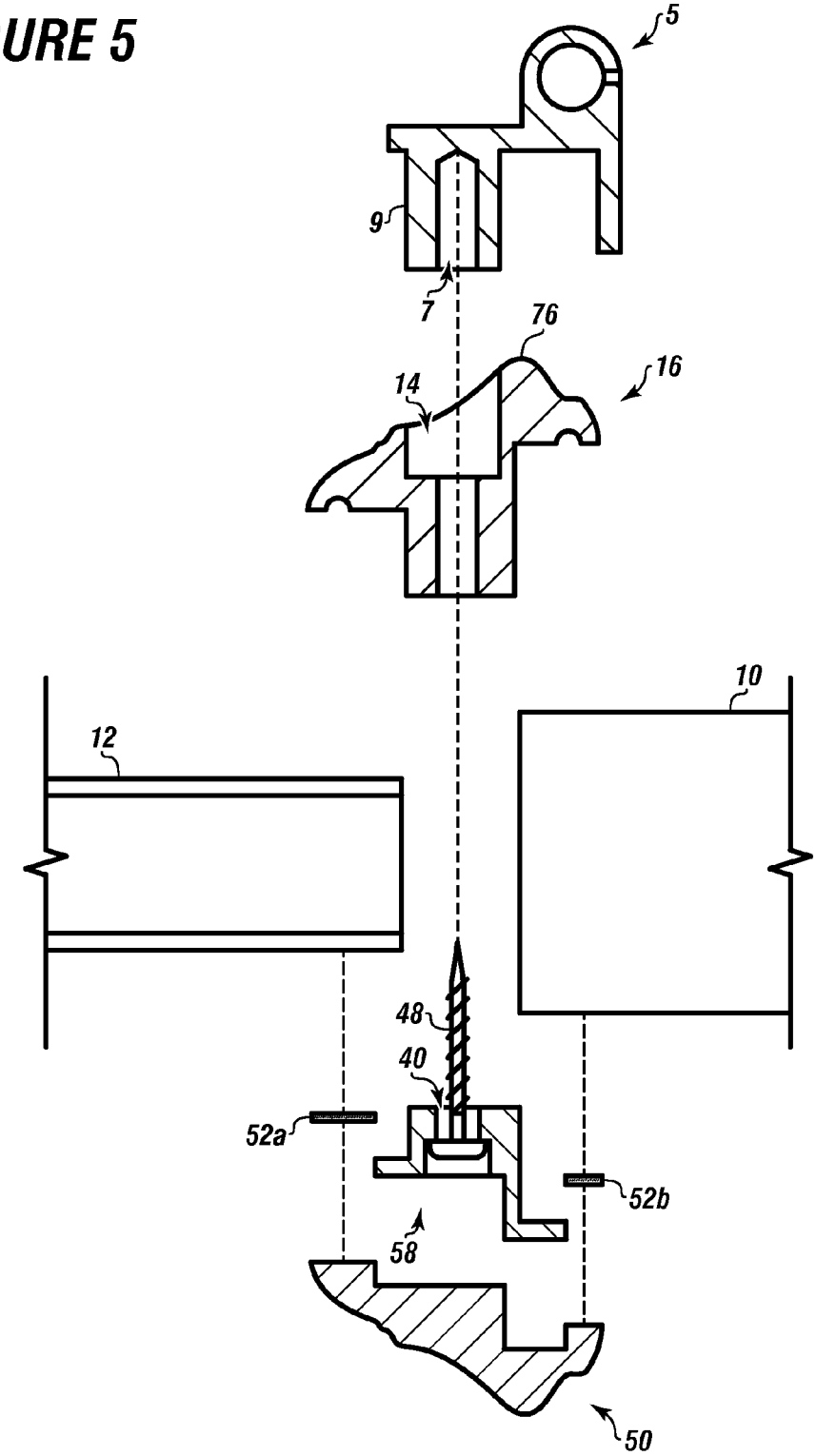
FIG. 5 depicts a detailed exploded view of a dual support connector assembly for a door or window assembly with an iron grill connector attached for security.

FIG. 5 depicts a detailed exploded view of a dual support connector assembly with an iron grill connector attachment for security.

The fastener 48 passes through the connector 58 and into a grill recess 7 in a grill connector 5 after passing through the exterior frame 16.

The grill recess 7 can be formed in a grill extension 9. The exterior frame 16 can have a grill chamber 14 for receiving the grill extension 9. The grill chamber 14 can have an opening formed through the decorative face 76.

The interior frame 50 can connect to the glass panel 12 and the structural panel 10 simultaneously, via fastening means 52*a* and 52*b*.

The fastener 48 can extend through the connector hole 40 of connector 58 and the exterior frame 16 and the grill connector 5. The interior frame 50 can cover the connector 58.

Figure 6:
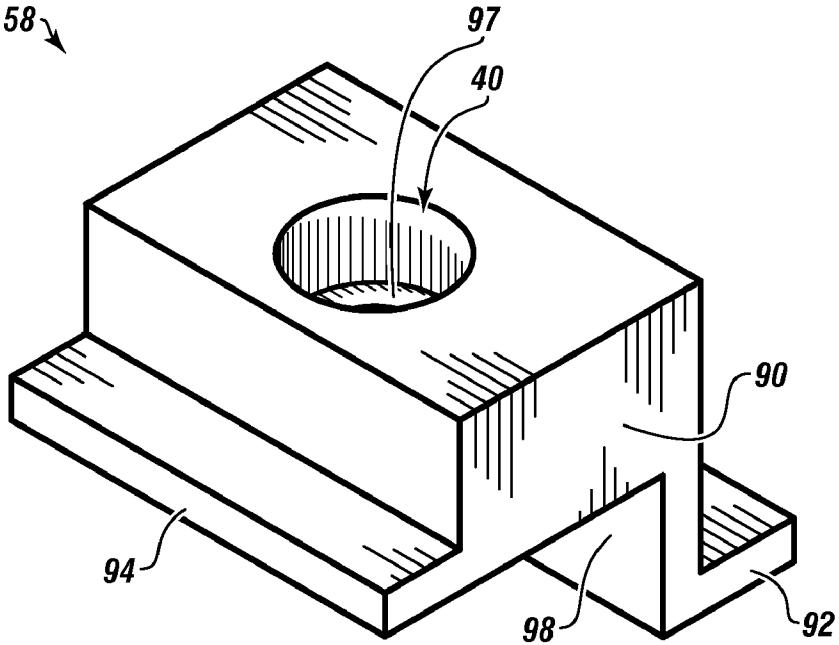
FIG. 6 shows an isometric view of a dual support connector usable to form the door assembly.

FIG. 6 shows an isometric view of a connector 58.

The connector 58 is shown with connector body 90 with the connector hole 40, a connector structural panel flange 92, an integral flange support portion 98, and a connector glass panel flange 94. The connector glass panel flange 94 can be integral with the connector body 90. The connector stop 97 is also depicted.

Figure 7:
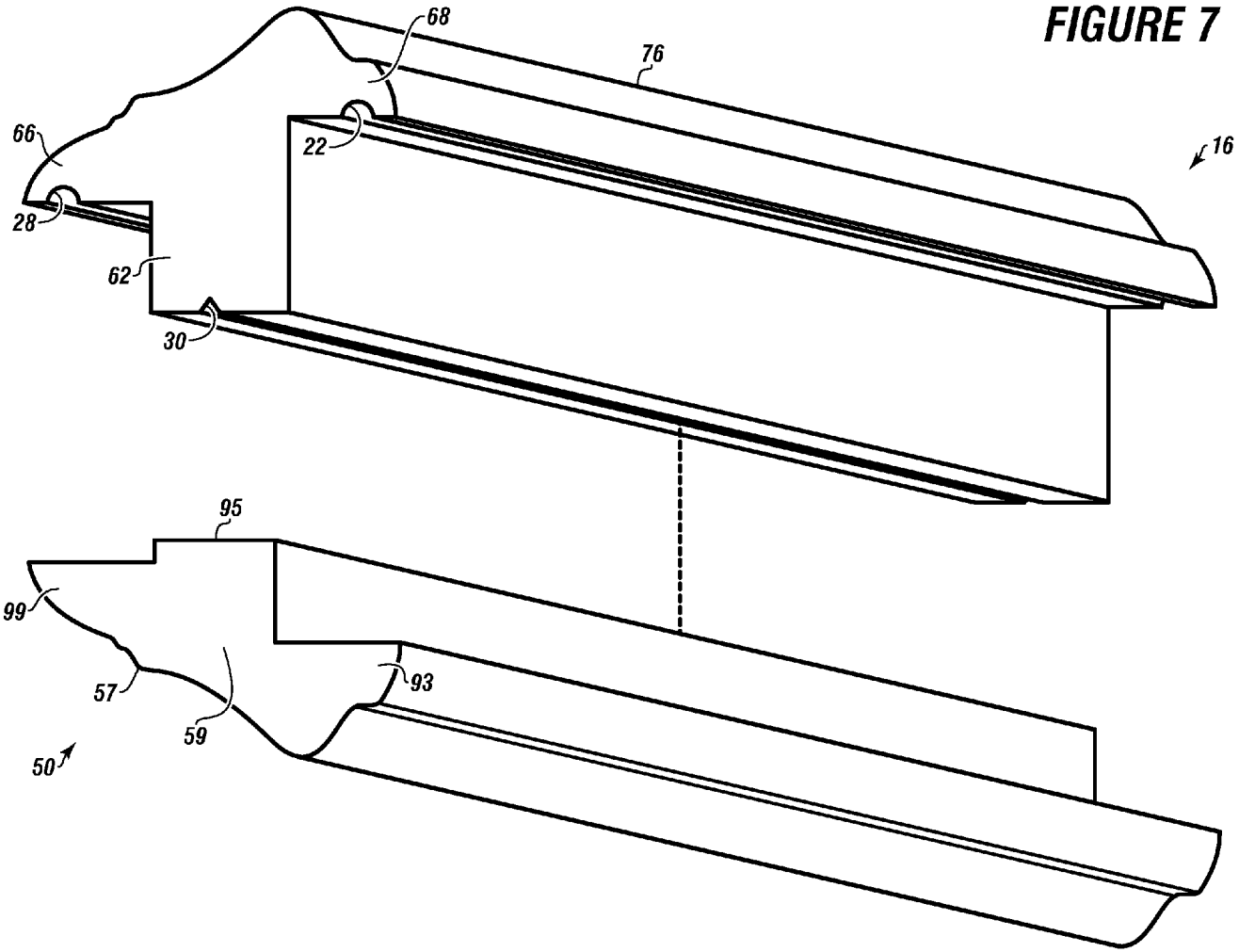
FIG. 7 depicts an isometric view of the exterior frame and the interior frame usable in the door assembly.

FIG. 7 depicts an isometric view of the exterior frame 16 and the interior frame 50.

The exterior frame 16 has decorative face 76, an exterior frame body portion 62, an exterior frame door flange 68, an exterior frame glass flange 66, a first gasket groove 22, a second gasket groove 28, and an alignment groove 30.

The interior frame 50 can have an interior frame intermediate face 95, the interior frame door flange 93, the interior frame glass flange 99, the interior frame decorative face 57, and the interior frame body 59.

Figure 8:
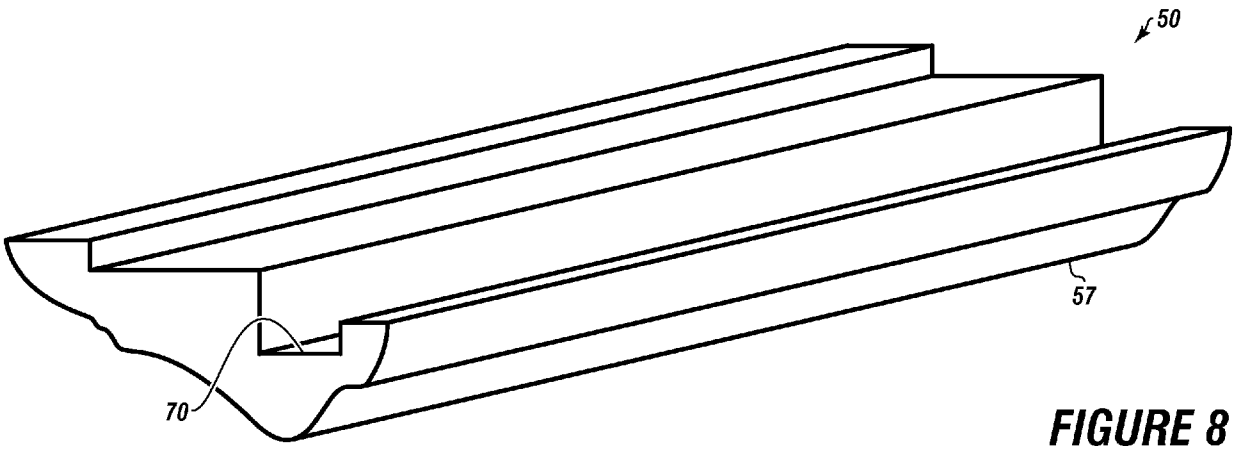
FIG. 8 depicts an isometric view of the interior frame of FIG. 7.

FIG. 8 depicts an isometric view of another embodiment of the interior frame 50.

The interior frame 50 can have a connector groove 70 on an opposite side of the interior frame decorative face 57. The connector groove 70 provides a flush fit with the connector.

Figure 9:
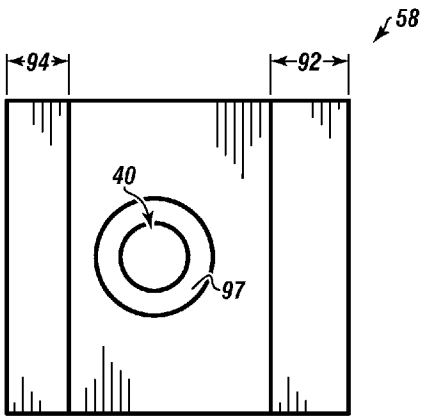
FIG. 9 depicts a top view of the dual support connector of FIG. 5 with the connector hole and a connector stop for preventing the head of a fastener from passing through the connector hole.

FIG. 9 depicts a top view of the connector 58 with the connector hole 40 and a connector stop 97 for preventing the head of a fastener from passing through the connector hole.

The connector structural panel flange 92 is depicted wider than the connector glass panel flange 94.

FIG. 10A depicts a kit created to retrofit a glass panel into a door already installed at a field location, such as at a house, at a chemical plant, or at a retail establishment. FIG. 10B depicts an isometric view of a shipping clip and a shipping fastener used to ship the kit.

Referring to FIGS. 10A and 10B, the kit includes the interior frame 50, the exterior frame 16, the glass panel 12, a plurality of shipping clips 3*a*-3*d* for snugly holding the glass pane to the exterior frame. Also, shipping fasteners 101*a*-101*d* can secure the connectors to the exterior frame. A seal means can be preinstalled in the exterior frame 16 and the interior frame 50 to seal the glass to the frames.

A shipping fastener can be disposed through each shipping fastener hole, such as a shipping fastener hole 103*a*. Each shipping fastener has a shipping fastener hole formed in the shipping clip body 105*a*.

While these embodiments have been described with emphasis on the embodiments, it should be understood that within the scope of the appended claims, the embodiments might be practiced other than as specifically described herein.

What is claimed is:

1. A door assembly comprising:

a. a door;

b. an opening in a support panel of the door;

c. a glass panel disposed in the opening;

d. an exterior frame for encircling contiguously, the opening on a first side of the door while simultaneously covering a structural edge of the support panel and a glass edge of the glass panel;

e. at least one first seal disposed between the exterior frame and the door, f. at least one second seal disposed between the exterior frame and the glass panel;

g. a plurality of dual support connectors connected to the exterior frame using a plurality of fasteners, wherein each dual support connector engages the support panel of the door and the glass panel simultaneously without making holes in the support panel of the door or the glass panel and without using an adhesive between the connector and the glass panel and the support panel; and wherein each dual support connector engages the exterior frame with a respective fastener of the plurality of fasteners; and h. an interior frame disposed over the plurality of dual support connectors covering the dual support connectors simultaneously as well as a glass edge portion of the glass panel and a panel edge portion of the structural panel of the door simultaneously.

2. The door assembly of claim 1, wherein the door is a fiberglass door, a steel door, or a composite door.

3. The door assembly of claim 1, wherein the dual support connector for a Craftsman door comprises:

a. a connector body;

b. a connector hole extending through the connector body; and c. a door flange integral with the connector body and extending at a right angle to a longitudinal axis of the connector hole for overlaying a panel edge portion of the structural panel without forming a hole in the structural panel; and d. a glass flange integral with the connector body and extending at a right angle to the longitudinal axis of the connector hole away from the connector body and parallel to while opposite from the door flange, wherein the glass flange overlays a glass edge portion of the glass panel without forming a hole in the glass panel.

4. The door assembly of claim 3, wherein the dual support connector is connected to the exterior frame with a fastener, and wherein the fastener is a screw, a nail, or a bolt having a head.

5. The door assembly of claim 3, wherein the dual support connector is affixed to the exterior frame with a fastener selected from the group: an epoxy, a flexible adhesive, or combinations thereof.

6. The door assembly of claim 3, wherein the connector hole of the dual support connector comprises a connector stop disposed in the connector hole for restraining the head of the fastener in the connector hole.

7. The door assembly of claim 1, wherein the first and second seals are a member of the group consisting of: a gasket, a curable silicone sealant, a cross linked elastomer, a resin, an adhesion promoter, a natural rubber, a synthetic rubber, or combinations thereof.

8. The door assembly of claim 1, wherein a fastening means is secured to the interior frame for engaging both an edge of the glass pane and an edge of the structural panel simultaneously, and the fastening means comprises a member of the group consisting of: double sided adhesive tape, an epoxy, a glue, and combinations thereof.

9. The door assembly of claim 1, wherein the dual support connector for non-Craftsman style doors comprises:

(i) a connector body;

(ii) a connector hole extending longitudinally through the connector body;

(iii) a connector glass flange integral with the connector body and extending at a right angle to a longitudinal axis of the connector hole away from the connector body for overlaying a glass edge portion of the glass panel; and (iv) a connector structural panel flange integral with the connector body and extending at a right angle to the longitudinal axis of the connector hole away from the connector body and in parallel with while opposite to the connector glass flange for overlaying a structural panel edge portion of the structural panel while in a plane apart from a plane of the connector glass flange.

10. The door assembly of claim 9, wherein the dual support connector is made from a group consisting of: aluminum, wood, alloys of metal, polyurethane, polyester, polyvinyl chloride (PVC), acrylonitrile butadiene styrene copolymer, polyamide, and styrene butadiene rubber copolymer, and combinations thereof.

11. The door assembly of claim 9, further comprising a connector groove in the exterior frame for engaging the dual support connector.

12. The door assembly of claim 9, wherein the connector body comprises: an integral flange support extending away from the connector body in parallel with the longitudinal axis of the connector hole, and further engaging the connector structural panel flange on an end opposite the connector body at a right angle.

13. The door assembly of claim 9, wherein the connector body is strip shaped and has a length from 2 cm to 12 cm.

14. The door assembly of claim 9, wherein the connector hole has a diameter from 1 mm to 6 mm and a depth from 3 mm to 12 mm.

15. The door assembly of claim 14, further comprising a connector stop in the connector hole to secure the head of a fastener in the connector hole.

16. The door assembly of claim 9, further comprising a grill connector engaging a grill recess in the exterior frame and the fastener.

17. The door assembly of claim 1, further comprising an antistatic coating disposed on the dual support connector.

* * * * *